US011075477B2

(12) United States Patent
Lin

(10) Patent No.: US 11,075,477 B2
(45) Date of Patent: Jul. 27, 2021

(54) CONNECTOR WITH DIRECT LOCKING STRUCTURE

(71) Applicant: P-TWO INDUSTRIES INC., Taoyuan (TW)

(72) Inventor: Hsien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/910,050

(22) Filed: Jun. 23, 2020

(65) Prior Publication Data

US 2021/0091495 A1 Mar. 25, 2021

(30) Foreign Application Priority Data

Sep. 24, 2019 (TW) ..... 108134742

(51) Int. Cl.
*H01R 12/77* (2011.01)
*H01R 12/79* (2011.01)

(52) U.S. Cl.
CPC ..... *H01R 12/774* (2013.01); *H01R 12/79* (2013.01)

(58) Field of Classification Search
None
See application file for complete search history.

(56) References Cited

U.S. PATENT DOCUMENTS 7,048,573 B2 * 5/2006 Masaki ..... H01R 12/79 439/492
7,435,131 B1 * 10/2008 Lee ..... H01R 12/79 439/354
8,043,114 B2 * 10/2011 Kaneko ..... H01R 12/716 439/497
9,236,686 B2 * 1/2016 Ohyama ..... H01R 13/629
2007/0054544 A1 * 3/2007 Hirata ..... H01R 13/6272 439/495

* cited by examiner

*Primary Examiner* — Ross N Gushi

(57) ABSTRACT

The invention discloses a connector with a direct locking structure. The connector comprises a male part and a female seat. The male part has a plurality of elastic parts, and each of the buckles is disposed on the outer sides of the plurality of the elastic parts. The female seat has a plurality of binding parts, and the binding parts respectively form two sides of the combining space, and the binding parts are correspondingly arranged to the buckles. The buckles are matched with the binding parts through deforming the elastic parts, so that the male parts and the female seats are further locked, wherein the locking of the male parts and the female seats are further released through deforming the elastic parts by the buckles and the binding parts.

10 Claims, 5 Drawing Sheets

A-A'

CONNECTOR WITH DIRECT LOCKING STRUCTURE

CROSS-REFERENCE TO RELATED APPLICATION

This application claims the benefit of Taiwan Patent Application No. 108134742, filed on Sep. 24, 2019, in the Taiwan Intellectual Property Office, the disclosure of which is entirely incorporated herein by reference.

FIELD OF THE INVENTION

The invention relates to a technical field of a connector, particularly a connector with a direct locking structure applied to a flexible flat cable.

BACKGROUND

Traditionally, flexible flat cables (FFC) are a data cable formed by laminating tin-plated flat copper wires with PET insulation through a production line of automatic equipment. The flexible flat cable is used to provide signal transmission, and has the advantages of being arbitrarily flexible, high-frequency signal transmission capability, and the like. Therefore, the flexible flat cables can be applied in fields of the automobiles, household appliances, display screens, and smart phones.

In order to allow an assembler to easily assemble without damaging the circuit board or the flexible flat cable, the invention provides a connector with a direct locking structure and allows the assembler to perform quick assembly.

SUMMARY

A first aspect of the invention is to provide a connector with a direct locking structure in order to connect a flexible flat cable to a printed circuit board.

A second aspect of the invention is, based on the connector with a direct locking structure, to provide a male part, combined with a flexible flat cable, to combine with a female seat on a circuit board.

A third aspect of the invention is to provide a deformable elastic body on the male part to lock the male part onto the female seat or releasing the male part from the female seat.

A fourth aspect of the invention is to provide a restricting groove and a restricting column on the male part for locking the flexible flat cable.

A fifth aspect of the invention is, based on the connector with a direct locking structure, to provide a cover extending from a first body of the male part to simplify the design of the connector.

A sixth aspect of the invention is, based on the connector with a direct locking structure, to provide a clamping plate on the male part for holding a flexible flat cable in an accommodating space.

In order to achieve the above aspects and other aspects, the invention provides a connector with a direct locking structure. A connector with direct locking structure comprises a male part and a female seat. The male part comprises a first body, a cover, two elastic parts and two buckles. The first body has a slot disposed on one side of the first body. The cover covers the slot and connects to the first body to form an accommodation space with the slot for receiving a flexible flat cable. The two elastic parts are respectively disposed on two sides of the first body and the slot, wherein each of the elastic parts extends from two sides of the first body and each of the elastic parts has a closed space formed therein. The two buckles are respectively disposed on the outer sides of the two elastic parts. The female seat comprises a second body and two binding parts. The second body has a combining space for receiving the first body. The two binding parts respectively disposed on two sides of the combining space, wherein the binding parts each is disposed correspondingly to the buckles each. When the first body is inserted into the combining space, the buckles and the binding parts are matched through deforming the elastic parts to lock the buckles and the binding parts. The locking of the buckles and the binding parts can be released through deforming the elastic parts to move the first body away from the combining space.

According to an embodiment, the connector further comprises a fixing member disposed on the second body for fixing the female seat to a printed circuit board.

According to another embodiment, the connector further comprises restricting grooves and restricting columns. The restricting grooves are disposed on the periphery of the slot of the first body. The restricting columns disposed on the periphery of the cover. When the cover is moved to cover the slot, the restricting columns are restricted by the restricting grooves to lock the cover onto the first body.

According to yet another embodiment, the restricting columns are disposed at positions corresponding to notches of the flexible flat cable.

According to still another embodiment, the restricting grooves are disposed on two sides of the slot, and the restricting columns are disposed on two sides of the cover and at positions corresponding to the restricting grooves.

According to still another embodiment, the cover extends from the first body.

According to still another embodiment, the connector further comprises a first positioning member and a second positioning member. The first positioning member disposed on the first body. The second positioning member disposed on the second body. The second positioning member is coupled to the first positioning member to fix the first body in the combining space of the second body.

According to still another embodiment, the binding parts are L-shaped binding parts, and the buckles are bumps. Each of the bumps is locked by each of the L-shaped binding parts to lock the elastic parts onto the first body.

According to still another embodiment, the connector further comprises a plurality of clamping plates disposed on the first body and on two sides of a connection site of the first body connecting the cover.

According to still another embodiment, a height of an opening of the accommodation space is not less than the thickness of the flexible flat cable.

Compared with the conventional technology, the invention provides a connector with a direct locking structure. In this connector structure, a male part pre-bonded with flexible flat cable and a female seat can be quickly assembled through the deformation of the elastic parts. This connector structure can be specially applied in miniaturized fields, such as automotive electronics, smart phones, smart tablets, notebooks, and televisions.

DETAILED DESCRIPTION

In order to fully illustrate the purpose, characteristics and effects of some embodiments of the invention, the following specific embodiments and the accompanying drawings are used to make a detailed description of some embodiments of the invention, which will be described as below.

In the disclosure of the invention, "a/an" or "one" is used to describe the units, elements and components described herein. The above is only for convenience of explanation and provides a general meaning to the scope of some embodiments of the invention. Therefore, unless it is obvious otherwise it means, such a description should be understood to comprise one, at least one, and the singular also includes the plural.

In the invention, the terms "comprising", "including", "having", "containing" or any other similar terms are intended to cover non-exclusive inclusions. For example, an element, structure, article, or device comprising a plurality of elements is not limited to only those elements listed herein, but may comprise an element, structure, article, or device that is not explicitly listed but is generally other inherent requirements. In addition, unless expressly stated to the contrary, the term "or" means an inclusive "or" rather than an exclusive "or".

Figure 1:
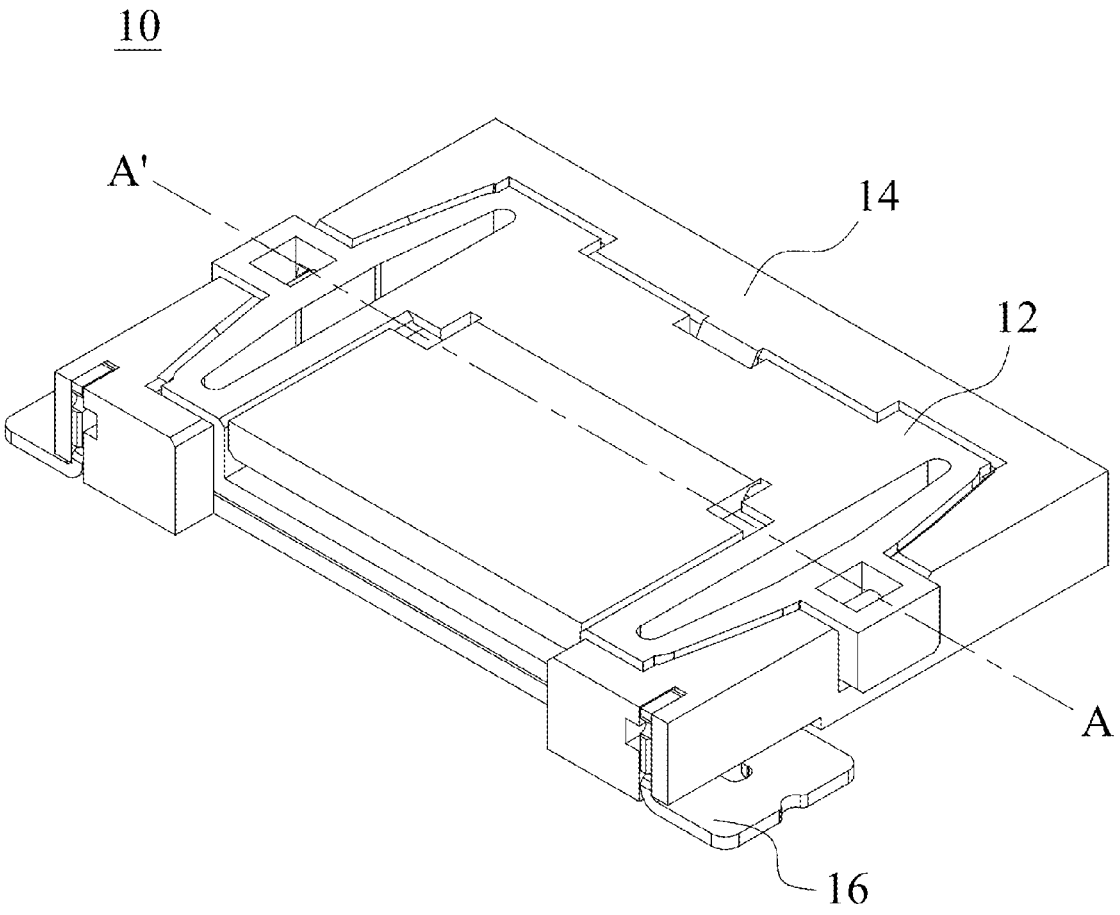
FIG. 1 is a schematic structural diagram showing a perspective view of a connector with a direct locking structure according to an embodiment of the invention, wherein the cover 124 is closed.

FIG. 1 is a schematic structural diagram showing a perspective view of a connector with a direct locking structure according to an embodiment of the invention, wherein the cover 124 is closed. A connector 10 is capable of connecting a flexible flat cable (not shown in the figure) and a printed circuit board (not shown in the figure). In FIG. 1, the connector 10 comprises a male part 12 and a female seat 14. The male part 12 can connect to a flexible flat cable, and the female seat 14 can connect to a printed circuit board. In some embodiments, the connector 10 may further comprise a fixing member 16 disposed on the female seat 14 for fixing the female seat 14 to the printed circuit board.

Figure 3:
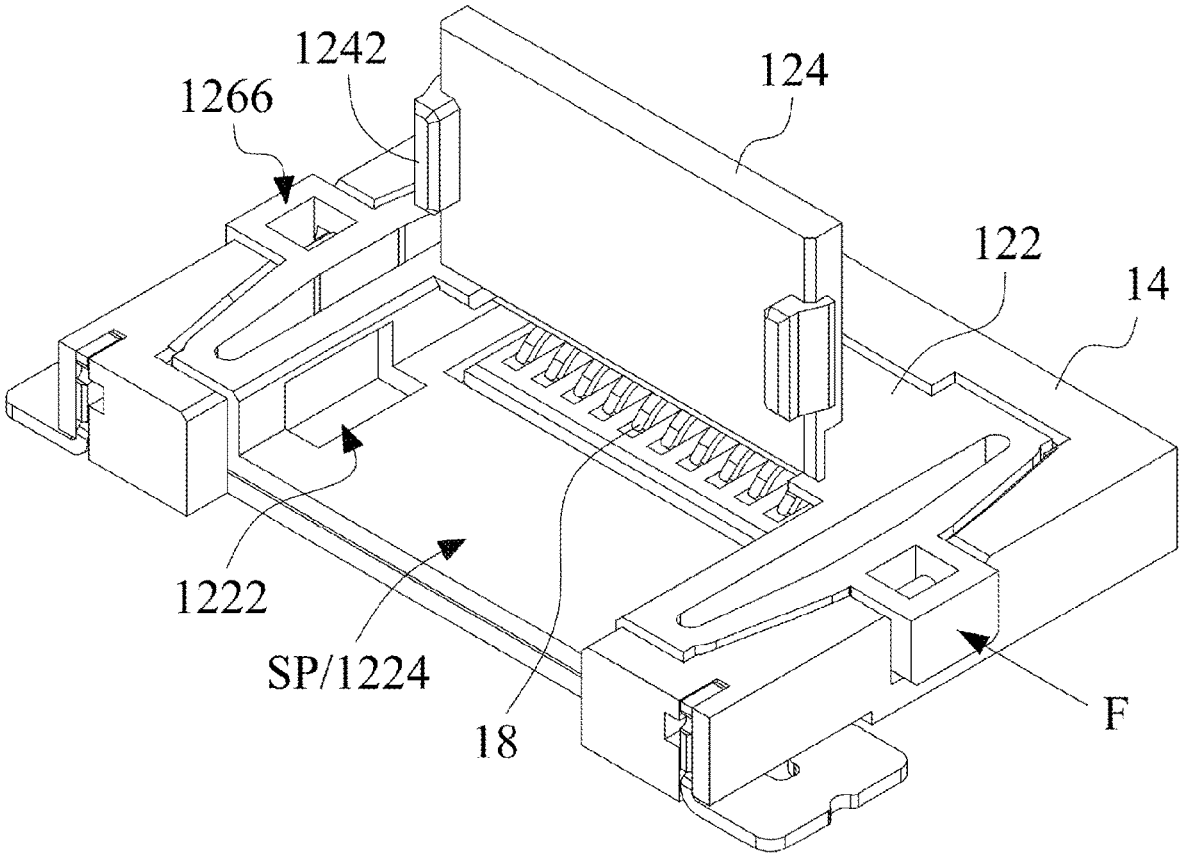
FIG. 3 is a schematic structural diagram showing a perspective view of the connector with a direct locking structure in FIG. 1, wherein the cover 124 is opened.

FIG. 3 is a schematic structural diagram showing a perspective view of the connector with a direct locking structure in FIG. 1, wherein the cover 124 is opened. In FIG. 3, the connector 10 may further comprise a conductive terminal 18, according to some other embodiments.

Figure 2:
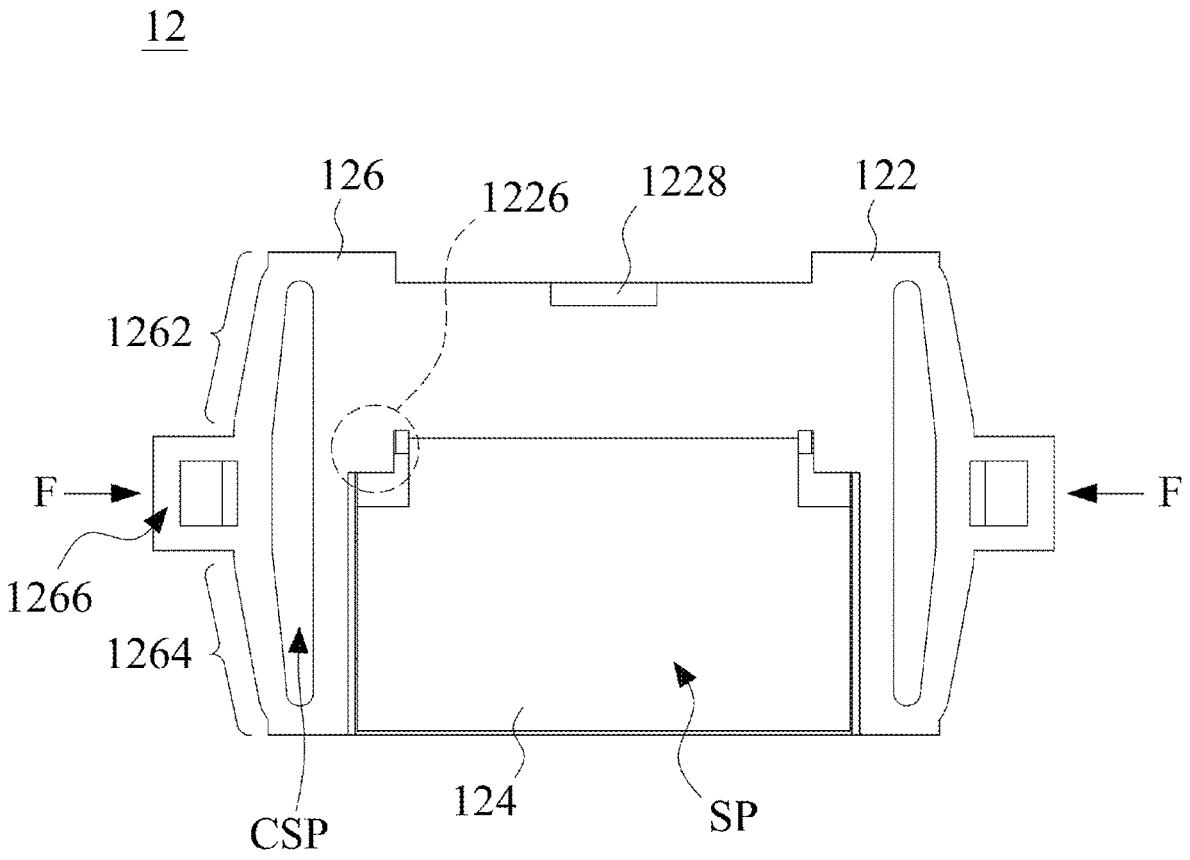
FIG. 2 is a detailed schematic structural diagram showing a top view of the male part 12 in FIG. 1.

FIG. 2 is a detailed schematic structural diagram showing a top view of the male part 12 in FIG. 1. In FIG. 2, the male part 12 comprises a first body 122, a cover 124, two elastic parts 126, and two buckles 1266.

The materials of the first body 122, the cover 124, the two elastic parts 126, and the buckles 1266 are insulators. The first body 122 has a slot 1224 disposed on one side of the first body 122. The cover 124 is connected to the first body 122 to form an accommodation space SP with the slot 1224 for receiving a flexible flat cable. The cover 124 covers the slot 1224. The cover 124 may be moved (or rotated) in a first direction towards the accommodation space SP to shutting off the cover 124. The cover 124 may also be moved (or rotated) in a second direction, opposite to the first direction, away from the accommodation space SP to lift up the cover 124. In this embodiment, the accommodation space SP refers to a space formed when the cover 124 is shut off. For example, a height of an opening of the accommodation space SP may be not less than the thickness of the flexible flat cable.

In FIG. 3, restricting grooves 1222 are disposed on the periphery of the slot 1244 of the first body 122, and restricting columns 1242 are disposed on the periphery of the cover 124, according to some other embodiments. When the cover 124 is moved to cover the slot 1244, the restricting columns 1242 are restricted by the restricting grooves 1222 to lock the cover 124 onto the first body 122. In still some other embodiments, the restricting grooves 1222 are disposed on two sides of the slot 1244, and the restricting columns 1242 are disposed on two sides of the cover 124 and at positions corresponding to the restricting grooves 1242. Furthermore, in yet some other embodiments, the restricting columns 1242 are disposed at positions corresponding to notches of the flexible flat cable.

In some embodiments, the cover 124 extends from the first body 122 and is connected to the first body 122 by the same material, and thus the cover 124 can be bent one or more times. In other embodiments, the buckles can be further used for buckling.

FIG. 2 is a detailed schematic structural diagram showing a top view of the male part 12 in FIG. 1. In FIG. 2, in this embodiment, a plurality of clamping plates 1226 are further disposed on the first body 122 and on two sides of a connection site where the first body 122 connecting the cover 124. Therefore, when the cover 124 is flipped, the cover 124 connected to the first body 122 slides under the clamping plates 1226 and provides a downward force. The clamping plates 1226 cooperate with the restricting groove 1222 and the restricting column 1242 to securely cover the cover 124 on the first body 122.

The two elastic parts 126 are respectively disposed on two sides of the first body 122 and the slot 1224. Each of the elastic parts 126 extends from two sides of the first body 122 and each of the elastic parts 126 has a closed space CSCP formed therein. The two buckles 1266 are respectively disposed on the outer sides of the two elastic parts 126. In the embodiment, the two elastic parts 126 have elastic arms 1262 and 1264, and the two buckles 1266 are disposed on outer sides of the elastic arms 1262 and 1264. When the elastic arms 1262 and 1264 are subjected to an external force F, an inward compressive force is generated on the elastic arms 1262 and 1264 to deform the shape of the closed space CSP. Thus, the positions of the two buckles 1266 are changed by deformation. For example, the two buckles 1266 may be bumps for subsequently combining with L-shaped binding parts, so that the two elastic parts 126 are locked on the first body 122.

Figure 4:
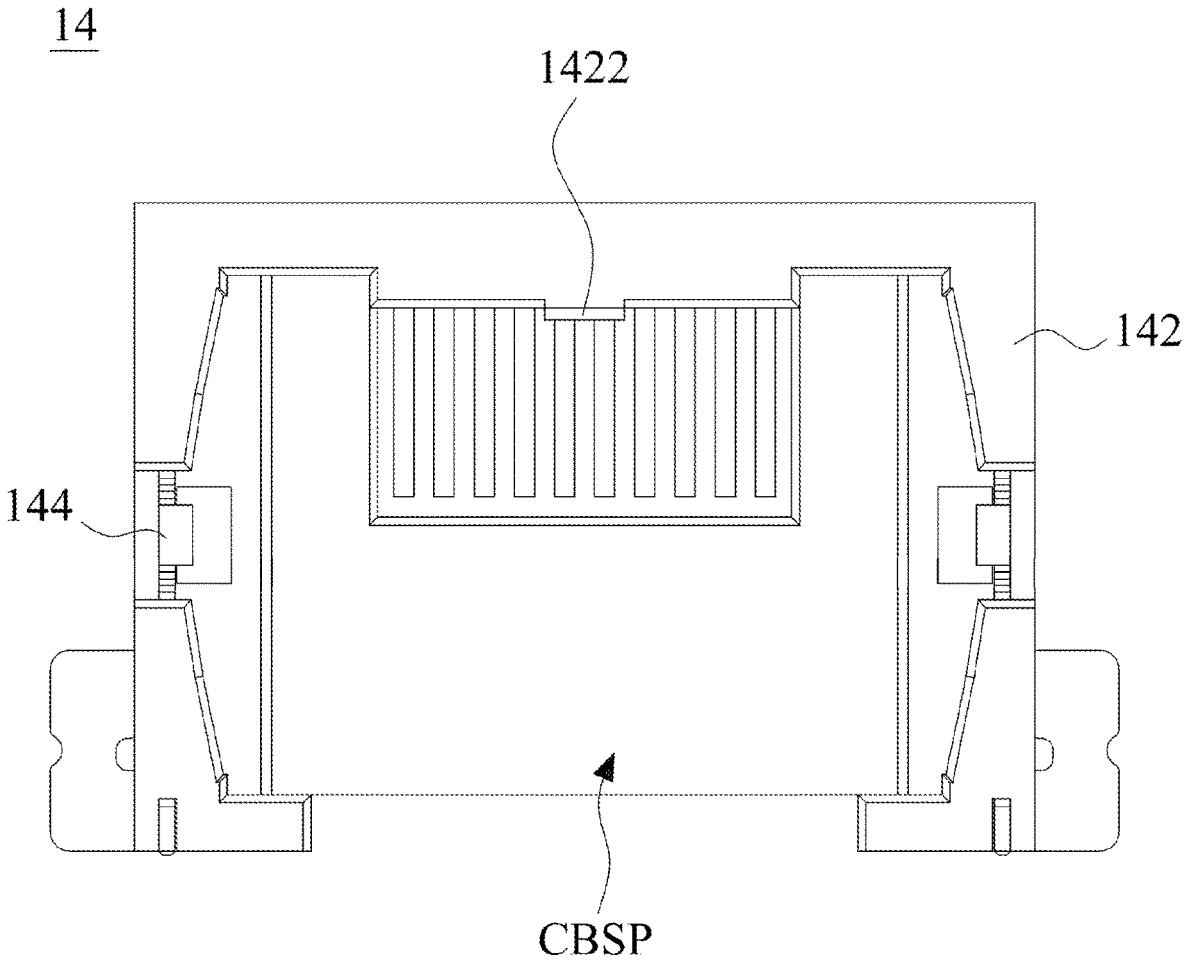
FIG. 4 is a detailed schematic structural diagram showing a top view of the female seat 14 in FIG. 1.

FIG. 4 is a detailed schematic structural diagram showing a top view of the female seat 14 in FIG. 1. In FIG. 4, the female seat 14 comprises a second body 142 and two binding parts 144. The second body 142 has a combining space CBSP for receiving the first body. The two binding parts 144 are respectively disposed on two sides of the combining space CBSP, wherein the binding parts 144 each is disposed correspondingly to the buckles 1266 each. The binding parts 144 may be L-shaped binding parts when the buckles 1266 are bumps, for example. Each of the bumps may be locked by each of the L-shaped binding parts to lock the elastic parts 126 onto the first body 122. The L-shaped binding parts may have a hook-shaped structure, for example. The shape of the combining space CBSP is disposed along the outer contour of the male part 12.

In FIGS. 2-4, in this embodiment, a first positioning member 1228 is further disposed on the first body 122, and a second positioning member 1422 is further disposed on the second body 142. The second positioning member 1422 is coupled to the first positioning member 1228 to fix the first body 122 in the combining space CBSP of the second body 142. The first body 122 may be disposed on the combining space CBSP through aligning the second positioning member 1422 with the first positioning member 1228.

Figure 5:
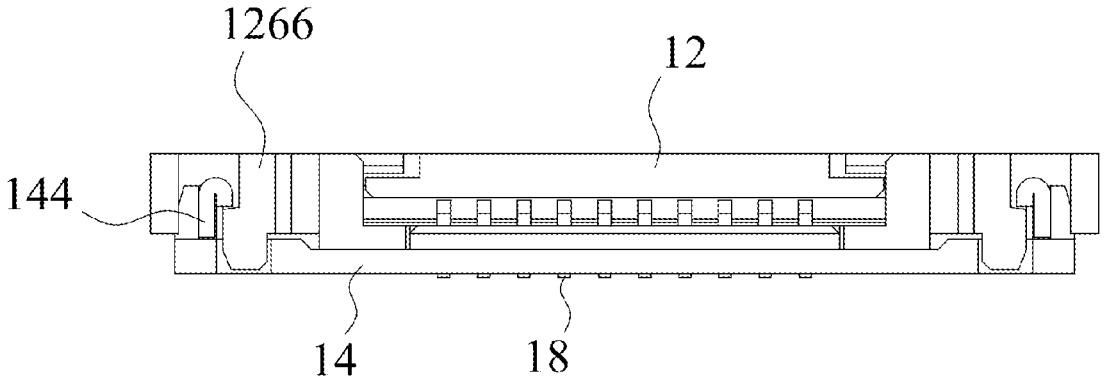
FIG. 5 is a schematic cross-sectional view along cutting line A-A', in which the male part 12 and a female seat 14 in FIG. 1 are assembled.

FIG. 5 is a schematic cross-sectional view along cutting line A-A', in which the male part 12 and a female seat 14 in FIG. 1 are assembled. In FIG. 5, when the first body 122 is inserted into the combining space CBSP, the buckles 126 and the binding parts 144 may be matched through deforming the elastic parts 126 to lock the buckles 1266 and the binding parts 144. Conversely, the locking of the buckles 1266 and the binding parts 144 may be released through deforming the elastic parts 126 to move the first body 122 away from the combining space CBSP.

The invention has been disclosed in the foregoing with some embodiments. However, those skilled in the art should understand that the embodiments are only used to describe the invention and should not be interpreted as limiting the scope of the invention. It should be noted that all changes and substitutions equivalent to the embodiments should be included in the scope of the invention. Therefore, the scope of protection of the invention shall be defined by the scope of the patent application.

What is claimed is:

1. A connector with direct locking structure comprising:

a male part, comprising:

a first body having a slot disposed on one side of the first body;

a cover covering the slot and connecting to the first body to form an accommodation space with the slot for receiving a flexible flat cable;

two elastic parts respectively disposed on two sides of the first body and the slot, wherein each of the elastic parts extends from two sides of the first body and each of the elastic parts has a closed space formed therein; and two buckles respectively disposed on the outer sides of the two elastic parts; and a female seat, comprising:

a second body having a combining space for receiving the first body; and two binding parts respectively disposed on two sides of the combining space, wherein the binding parts each is disposed correspondingly to the buckles each, when the first body is inserted into the combining space, the buckles and the binding parts are matched through deforming the elastic parts to lock the buckles and the binding parts, and the locking of the buckles and the binding parts are released through deforming the elastic parts to move the first body away from the combining space.

2. The connector of claim 1, further comprising a fixing member disposed on the second body for fixing the female seat to a printed circuit board.

3. The connector of claim 1, further comprising:

restricting grooves disposed on the periphery of the slot of the first body;

restricting columns disposed on the periphery of the cover, when the cover is moved to cover the slot, the restricting columns are restricted by the restricting grooves to lock the cover onto the first body.

4. The connector of claim 3, wherein the restricting columns are disposed at positions corresponding to notches of the flexible flat cable.

5. The connector of claim 3, wherein the restricting grooves are disposed on two sides of the slot, and the restricting columns are disposed on two sides of the cover and at positions corresponding to the restricting grooves.

6. The connector of claim 1, wherein the cover extends from the first body.

7. The connector of claim 1, further comprising:

a first positioning member disposed on the first body;

a second positioning member disposed on the second body, wherein the second positioning member is coupled to the first positioning member to fix the first body in the combining space of the second body.

8. The connector of claim 1, wherein the binding parts are L-shaped binding parts, the buckles are bumps, and each of the bumps is locked by each of the L-shaped binding parts to lock the elastic parts onto the first body.

9. The connector of claim 1, further comprising a plurality of clamping plates disposed on the first body and on two sides of a connection site of the first body connecting the cover.

10. The connector of claim 1, wherein a height of an opening of the accommodation space is not less than the thickness of the flexible flat cable.

* * * * *